US011844429B2

(12) United States Patent
Stevens et al.

(10) Patent No.: US 11,844,429 B2
(45) Date of Patent: Dec. 19, 2023

(54) CABINET STORAGE SYSTEM

(71) Applicant: Rev-A-Shelf Company, LLC, Louisville, KY (US)

(72) Inventors: Leeman Elliot Stevens, Shelbyville, KY (US); Paul Franklin Chambers, Louisville, KY (US); Kevin M. Ward, Louisville, KY (US); David P. Noe, Louisville, KY (US); Steve M. Jones, Jr., Louisville, KY (US)

(73) Assignee: REV-A-SHELF COMPANY, LLC, Louisville, KY (US)

( * ) Notice: Subject to any disclaimer, the term of this patent is extended or adjusted under 35 U.S.C. 154(b) by 0 days.

(21) Appl. No.: 17/577,909

(22) Filed: Jan. 18, 2022

(65) Prior Publication Data

US 2022/0225765 A1 Jul. 21, 2022

Related U.S. Application Data

(63) Continuation of application No. 17/300,311, filed on Jan. 18, 2021.

(51) Int. Cl.

| | |
|---|---|
| ***A47B 88/40*** | (2017.01) |
| ***A47B 77/18*** | (2006.01) |
| ***B65F 1/14*** | (2006.01) |
| ***A47B 88/919*** | (2017.01) |
| *B65F 1/12* | (2006.01) |

(52) U.S. Cl.

CPC ..... *A47B 77/18* (2013.01); *A47B 88/40* (2017.01); *A47B 88/919* (2017.01); *B65F 1/1436* (2013.01); *B65F 1/12* (2013.01)

(58) Field of Classification Search

CPC ..... A47B 77/18; A47B 88/40; A47B 88/919; B65F 1/12; B65F 1/1436

USPC ..... 312/334.13, 334.27, 348.4

See application file for complete search history.

(56) References Cited

U.S. PATENT DOCUMENTS

| | | | | |
|---|---|---|---|---|
| 4,199,200 A * | 4/1980 | Livingston | A47B 88/407 384/19 |
| 5,601,350 A * | 2/1997 | Rock | A47B 88/43 312/348.1 |
| 5,779,333 A * | 7/1998 | Lautenschlager | A47B 88/43 312/334.14 |
| 6,390,576 B1 * | 5/2002 | Walburn | A47B 88/956 312/348.4 |
| 6,817,686 B1 * | 11/2004 | Whittlesea | A47B 88/427 312/348.4 |

(Continued)

*Primary Examiner* — James O Hansen

(74) *Attorney, Agent, or Firm* — Crowell & Moring LLP

(57) ABSTRACT

A cabinet storage system for a cabinet includes a base and a pair of slides. Each of the slides includes a face frame lip standoff extending from a front edge of a respective slide to align the cabinet storage system in a bottom of the cabinet. A bracket may be coupled with each respective slide, the bracket includes a face frame bracket positioned to extend beyond the front edge of the respective slide and the face frame lip. The face frame bracket is available to couple a cabinet front to the cabinet storage system. A slidable portion of each of the slides may include front ears and rear ears. The front ears include apertures to receive a first fastener coupled with the base, and the rear ears including an alignment notch to guide the base into alignment with a respective slide using a second fastener coupled with the base.

16 Claims, 21 Drawing Sheets

(56) References Cited

U.S. PATENT DOCUMENTS

| | | | | |
|---|---|---|---|---|
| 2015/0208801 | A1* | 7/2015 | Hu | A47B 88/427<br>248/346.06 |
| 2016/0081473 | A1* | 3/2016 | Jiang | A47B 88/473<br>312/334.33 |
| 2017/0172300 | A1* | 6/2017 | Bowman | A47B 88/487 |
| 2019/0298059 | A1* | 10/2019 | Chen | A47B 88/994 |
| 2020/0245766 | A1* | 8/2020 | Rechberg | F16C 29/046 |

* cited by examiner

CABINET STORAGE SYSTEM

PRIORITY CLAIM

This application is a continuation of U.S. patent application Ser. No. 17/300,311, filed Jan. 18, 2021, which is entirely incorporated by reference.

FIELD

The present disclosure relates generally to a cabinet storage system for use in a cabinet or other enclosure.

BACKGROUND

Cabinets such as storage cabinets for kitchens, bathrooms, closets, offices and other uses can include one or more receptacles, such as drawers or shelves for storing articles. The drawers and shelves can be designed to be moved between an open position and a closed position. While in the open position, a drawer or shelf may be extended away from the storage cabinet or other enclosure so as to receive the articles. In the closed position, the drawer or shelf may be recessed within the storage cabinet or other enclosure in which the drawer or shelve is installed. The size and weight of such drawers or shelves can vary. In addition, the weight, type, and/or number of articles that can be stored on the drawers or shelves can be quite different in different applications.

DRAWINGS

The system may be better understood with reference to the following drawings and description. The components in the figures are not necessarily to scale, emphasis instead being placed upon illustrating the principles of the invention. Moreover, in the figures, like referenced numerals designate corresponding parts throughout the different views.

The drawings described herein are for illustration purposes only and are not intended to limit the scope of the present disclosure in any way.

DETAILED DESCRIPTION

The following description is merely exemplary in nature and is not intended to limit the present disclosure, application, or uses.

Figure 1:
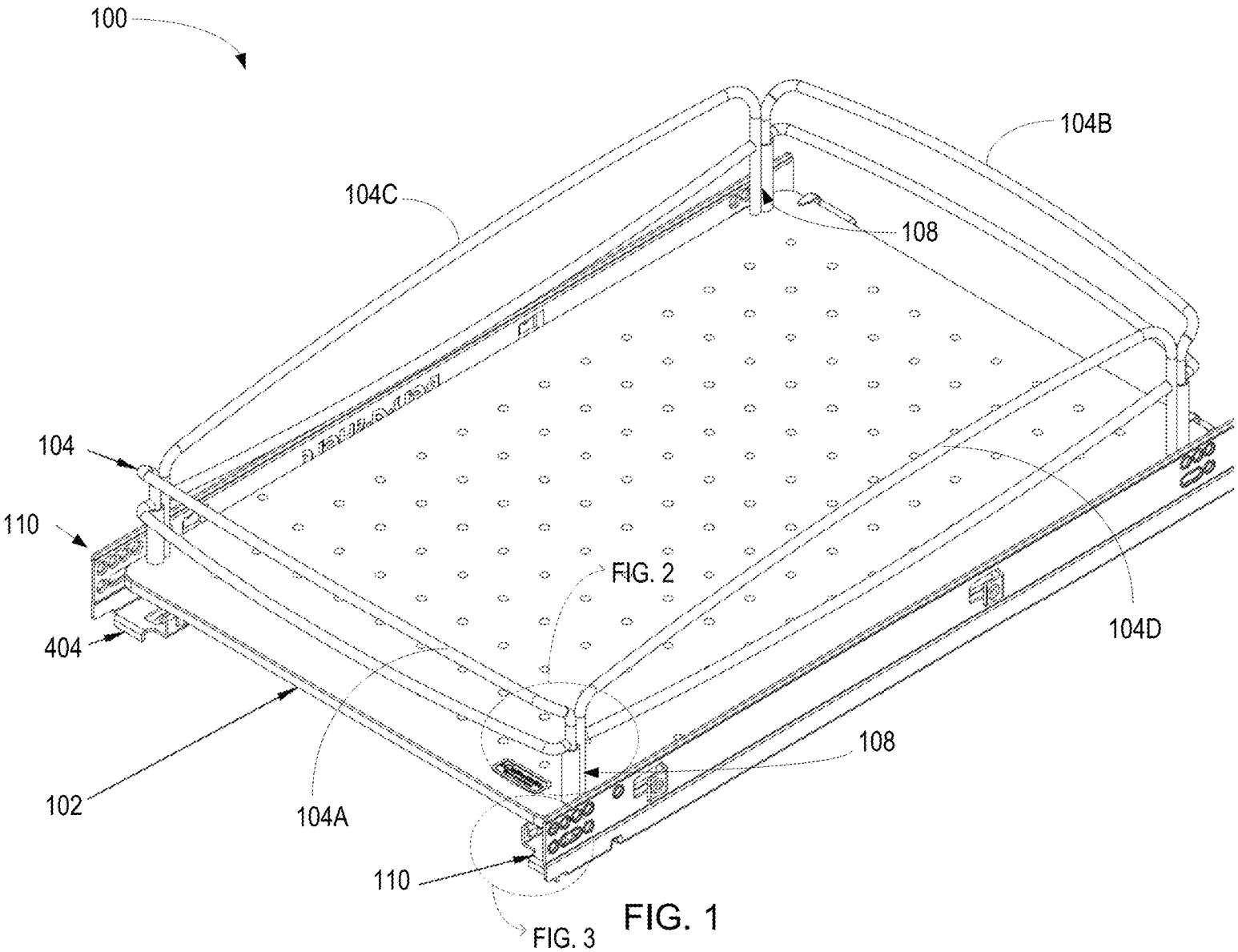
FIG. 1 is a perspective view of an example cabinet storage system.
Figure 21:
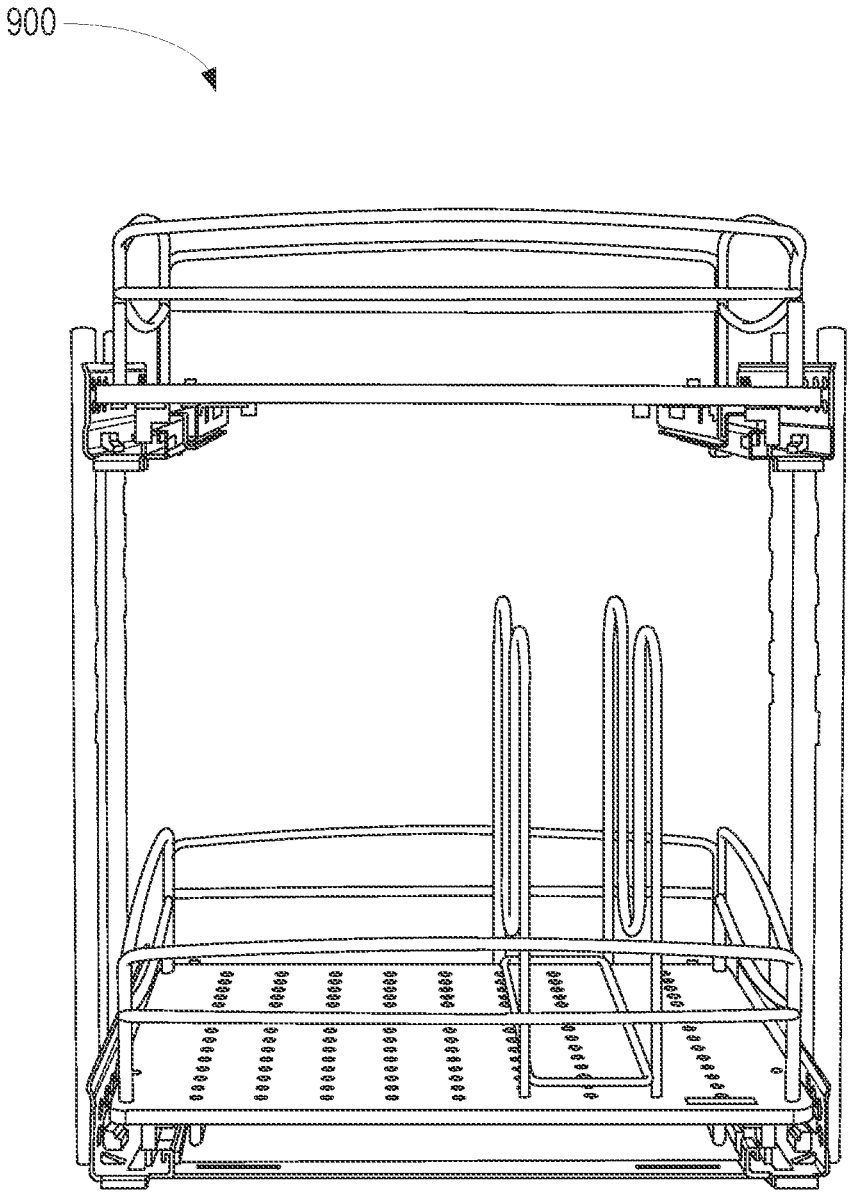
FIG. 21 is a perspective view of another example multi-level drawer cabinet storage system.

FIG. 1 is an example of a cabinet storage system 100, which may also be described as a single level drawer cabinet storage system. The cabinet storage system 100 may be mounted in a cabinet or other enclosure. As illustrated in the various examples of FIGS. 1-8 and 19, the cabinet storage system 100 includes a base 102. The base 102 may be a rigid material, such as metal, or wood, or engineered wood, and include apertures into which wires or rods may be frictionally mounted to provide dividers, shelves and/or organizer features on the base 102, as illustrated in FIG. 21.

Figure 3:
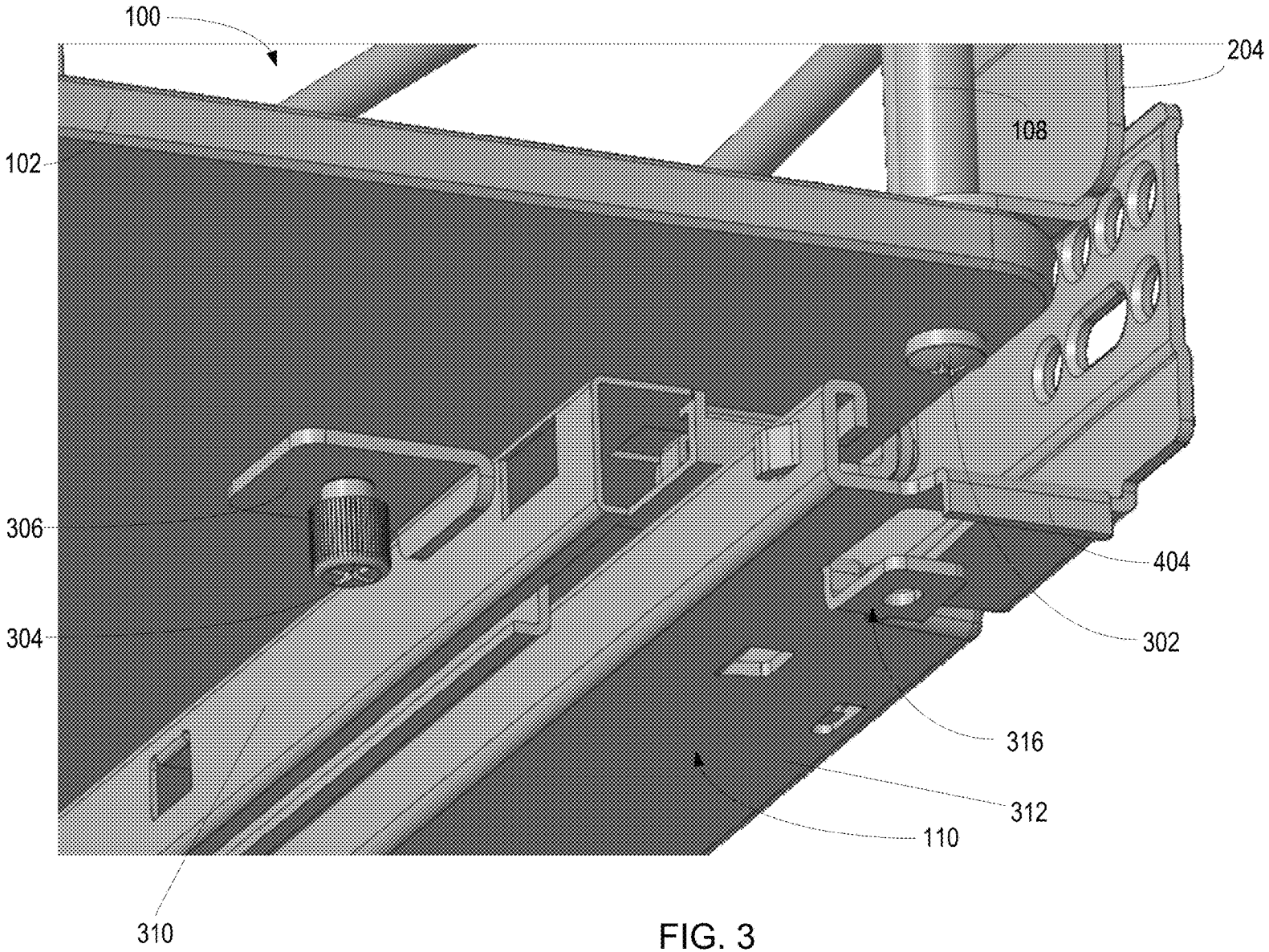
FIG. 3 is a perspective view of a bottom portion of another example cabinet storage system similar to the system of FIG. 1.
Figure 4:
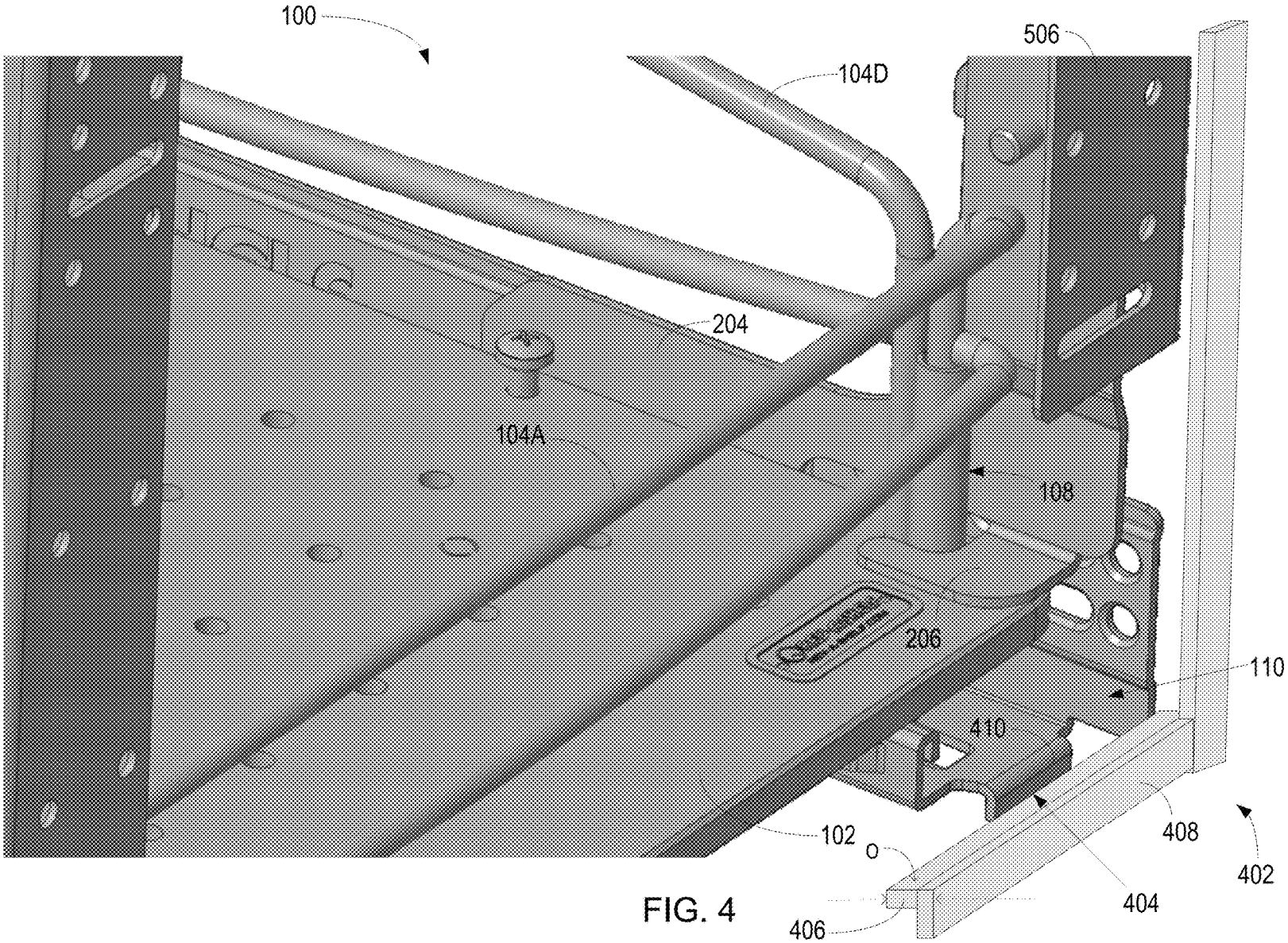
FIG. 4 is a perspective view of a portion of another example cabinet storage system similar to FIGS. 2-4.

The cabinet storage system 100 may include one or more fences 104 positioned around the perimeter of at least part of the base 102. In the illustrated example, the fences include front and rear fences 104A and 104B, respectively, and left and right side fences 104C and 104D, respectively. The front and rear fences 104A and 1048 and the left side and right side fences 104C and 104D include vertical members holding horizontal members spaced away from the base 102. The base 102 may be described as a horizontal shelf having a horizontal planar surface. Structural columns 108 are coupled to the base 102 by fasteners 302 as illustrated in FIG. 3. The base 102, the fences 104 and the structural columns 108 may be made of wood, metal, plastic, composite, and/or any other rigid material. In an example, the base 102 is made of wood and the fences 104 and structural columns 108 are made of metal. In another example, base 102 is made of metal, such as in the form of wire. In other examples, other configurations of rigid materials may be used.

Figure 8:
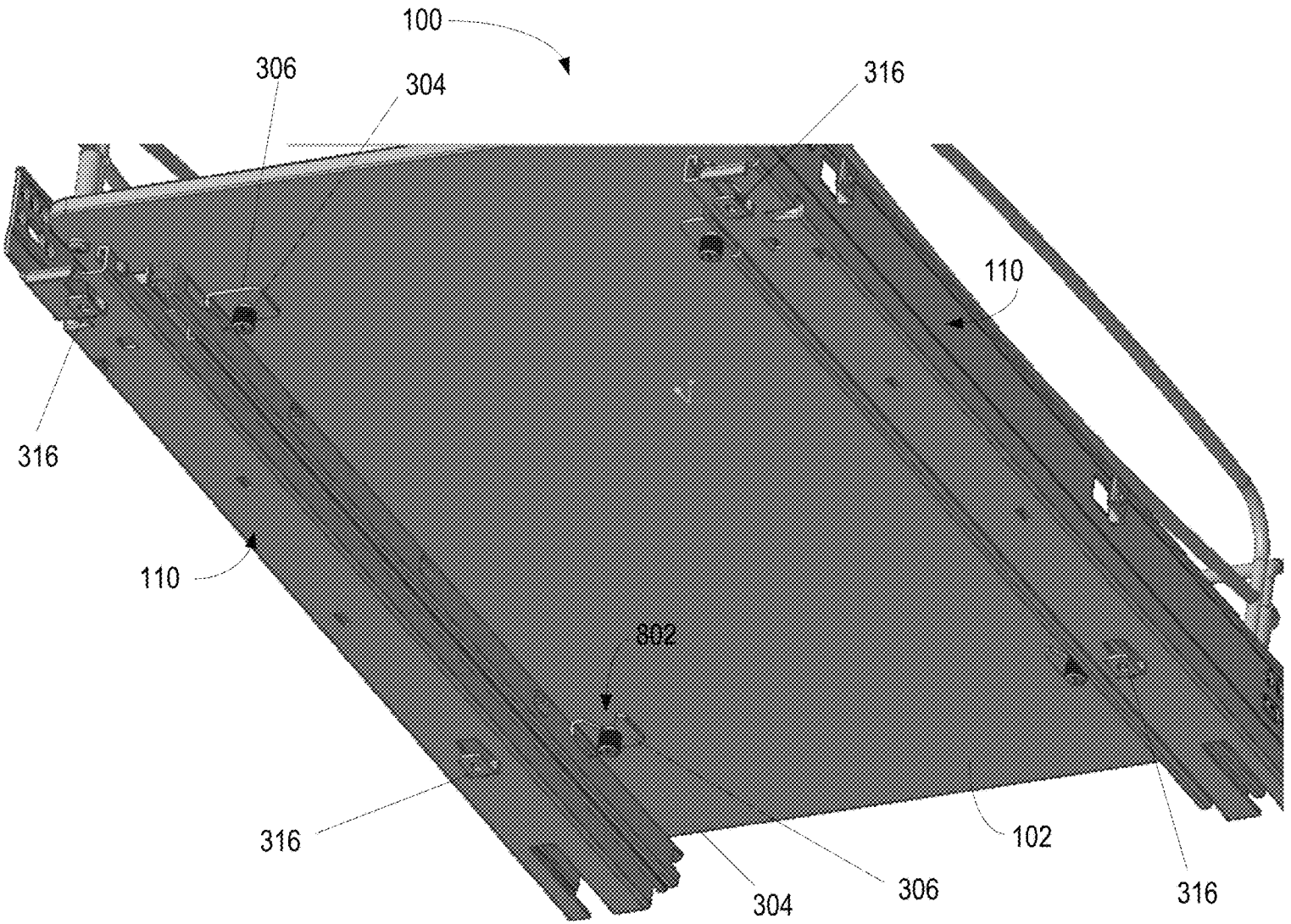
FIG. 8 is bottom perspective view of the example cabinet storage system of FIG. 1.

In an example, the structural columns 108 may be threaded sleeves at a first end that accommodate a threaded bolt such that the base 102 is compressed between the structural columns 108 and the fasteners 302 as the fasteners 302 are tightened as illustrated in the example of FIG. 3. The base 102 is coupled to a pair of slides 110 by fasteners 304, which extend through ears 306 fixedly coupled to each respective one of the slide members 110 and are threadly connected with the base 102 as illustrated in the examples of FIGS. 3 and 8. The fasteners 304 may be thumb screws mechanically tightened by hand using a grooved head of the fastener 304 or with a tool such as a screwdriver to removably and fixedly couple the base 102 to the slides 110. The ears 306 shown in FIG. 3 are the front ears, which are aligned with threaded apertures in the base 102 during installation of the slides 110. As illustrated in FIG. 8, the ears 306 at the rear of the base 102 are guide ears 306 that include an alignment notch 802, used to guide the base 102 into proper alignment with the slides 110 by installing the fasteners 304 in the base 102 and then sliding the base 102 forward to enter the alignment notch 802 and thereby align the slide 110 with the front ears 306 for installation of the respective fastener 304.

Each of the slide members 110 are telescoping slide members which include a slideable portion 310 and a fixed base portion 312. The slideable portion 310 is coupled with the base 102, and the fixed base portion 312 may be coupled with the bottom of the cabinet, so that the slidable portion 310 and the base 102 are movable together to extend away from the fixed base portion 312 in order to be positioned outside the cabinet in which the cabinet storage system 100 is mounted.

Figure 2:
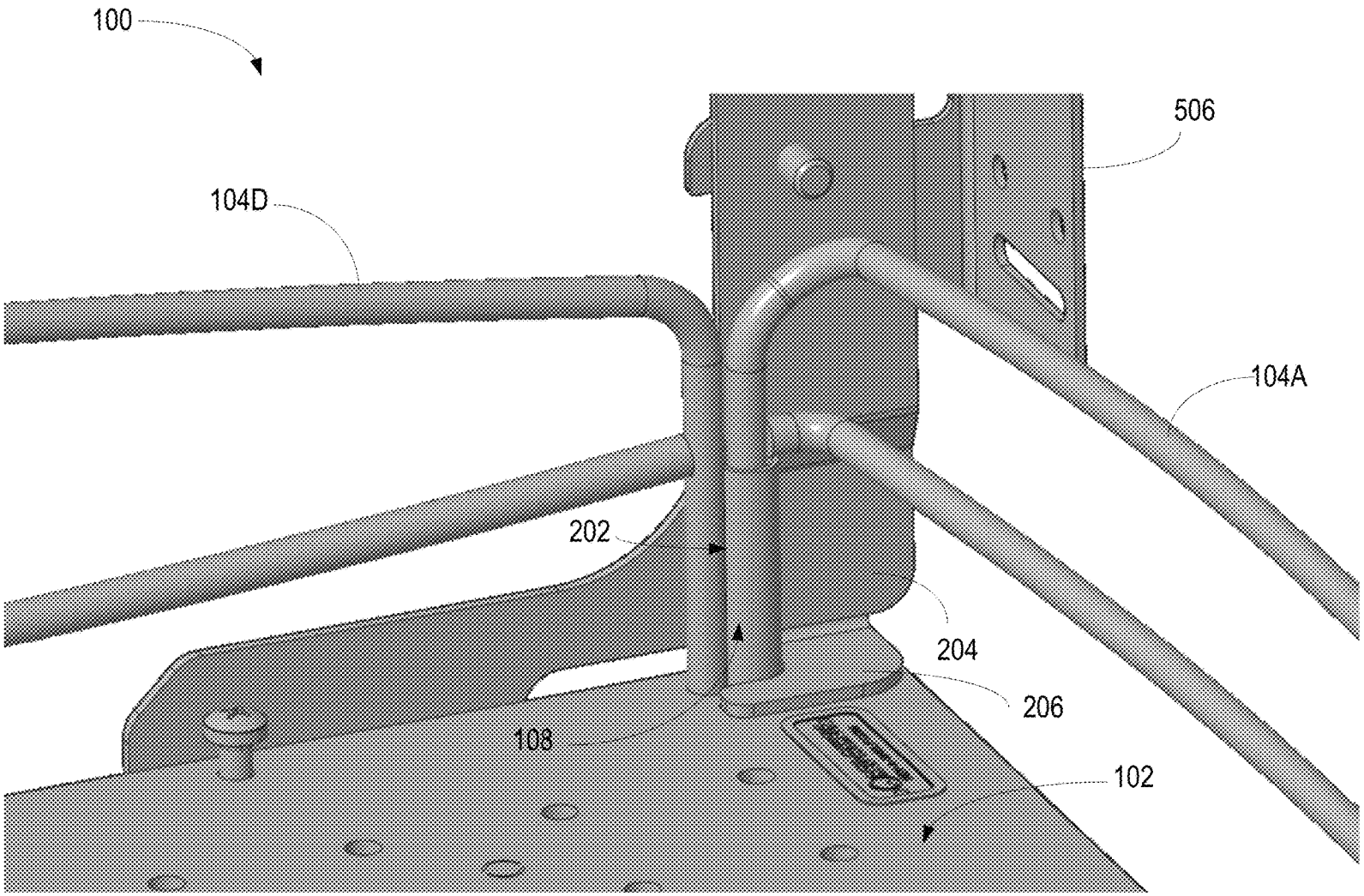
FIG. 2 is a perspective view of a top portion of another example cabinet storage system similar to the system of FIG. 1.

The structural columns 108 may be a cylindrical sleeve at a second end with appropriate diameter to receive and hold the front and rear fences 104A and 1048, such as by friction fit, as illustrated in FIGS. 1 and 2. As further illustrated in FIG. 2, the side fences 104C and 104D may be fixedly coupled to an outer surface of the structural columns 108 by a coupler 202, such as by a tack weld, braise, strap, fastener or some other holding mechanism. As illustrated in FIG. 1, the structural columns 108 at the rear of the cabinet storage system 100 extend further from the planar surface of the base 102 such that the side fences 104C and 104D are increasing spaced away from the planar surface of the base 102 as the side fences 104C and 104D extend from a front of the base 102 to a rear of the base 102. Also, the front and rear fences 104A and 1048, which are held in the cylindrical sleeves of the structural columns are interchangeable to minimize parts for manufacture.

Figure 5:
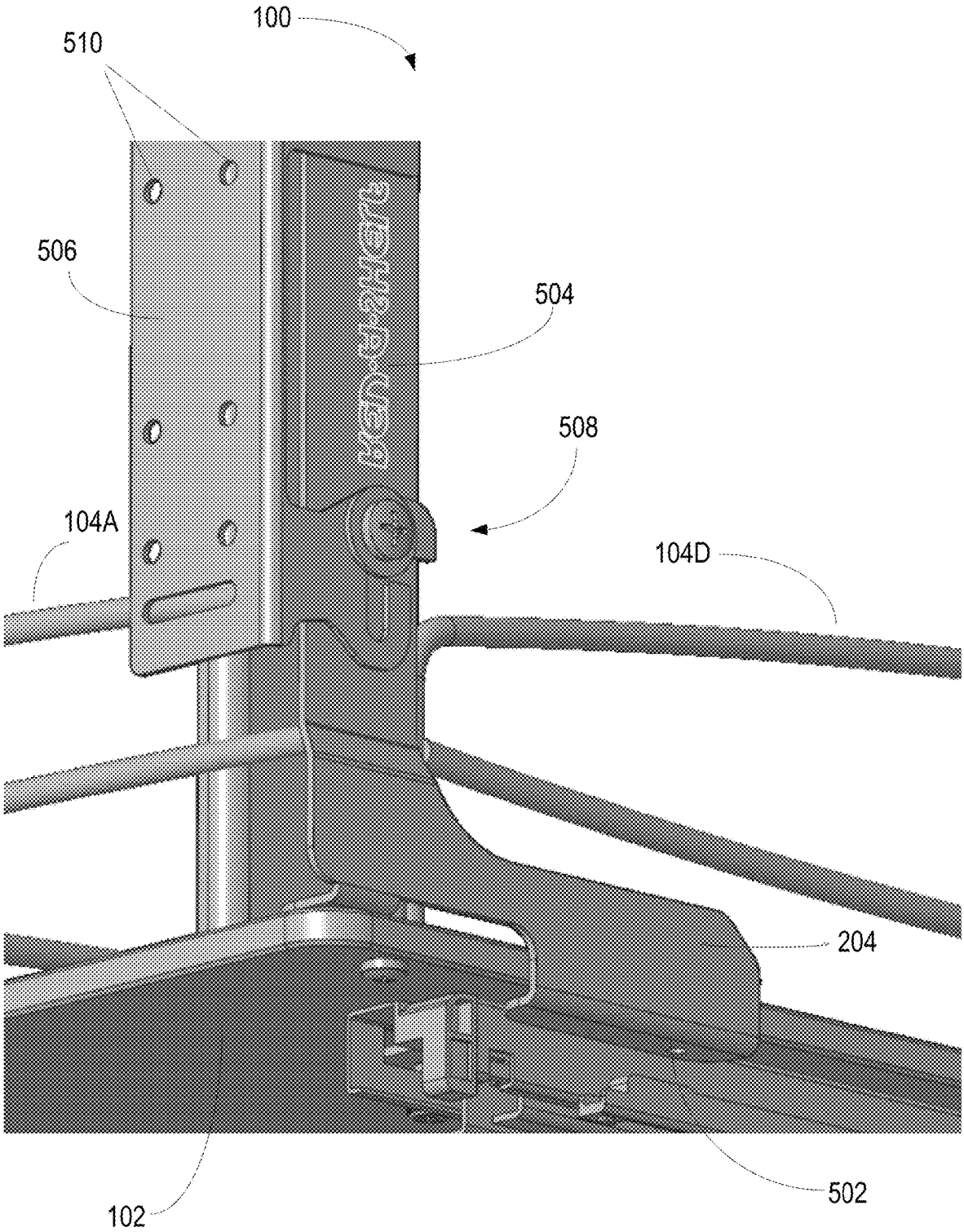
FIG. 5 is top perspective view of a portion of the example cabinet storage system of FIG. 1.
Figure 6:
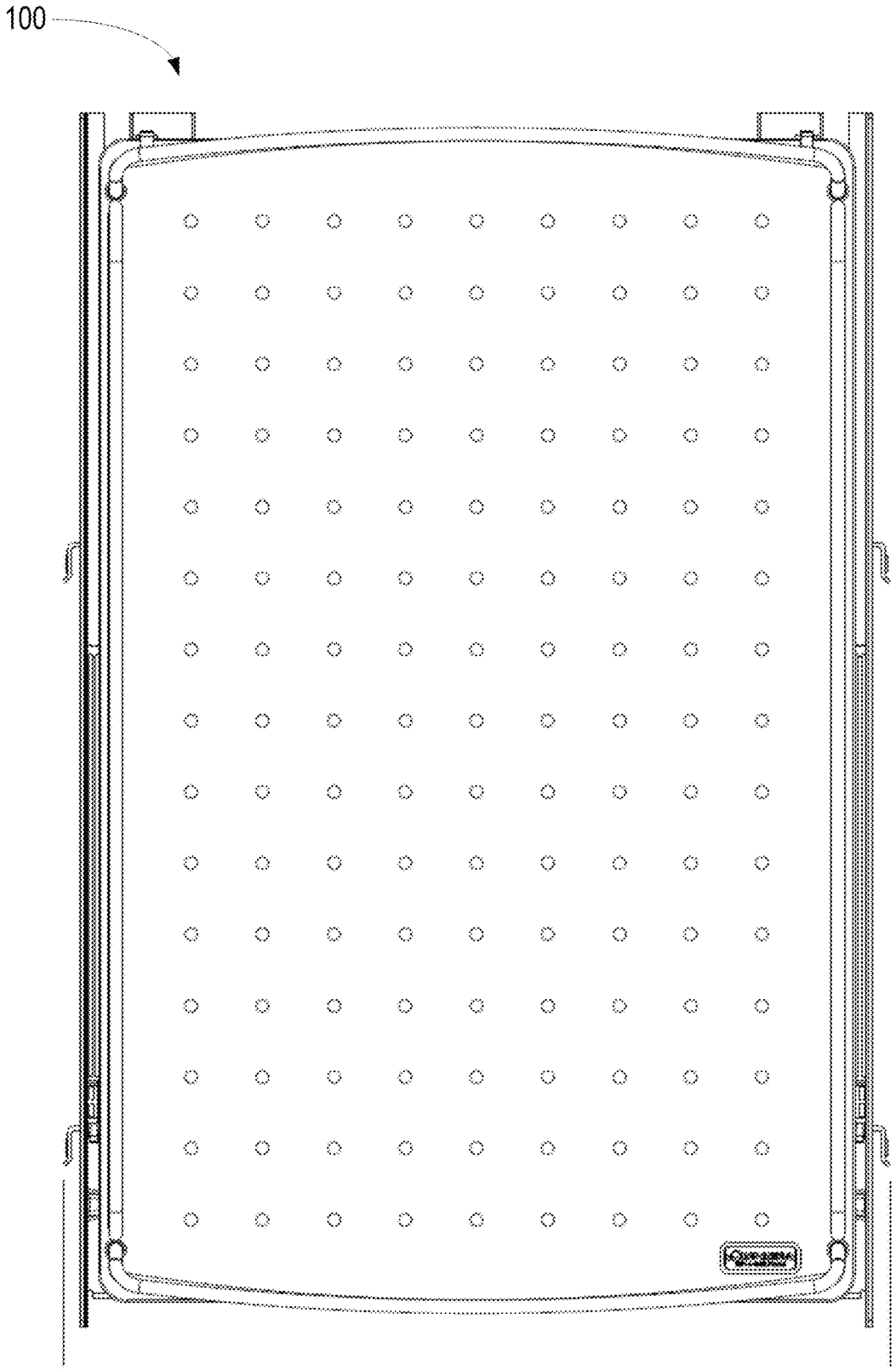
FIG. 6 is top view of the example cabinet storage system of FIG. 1.
Figure 7A:
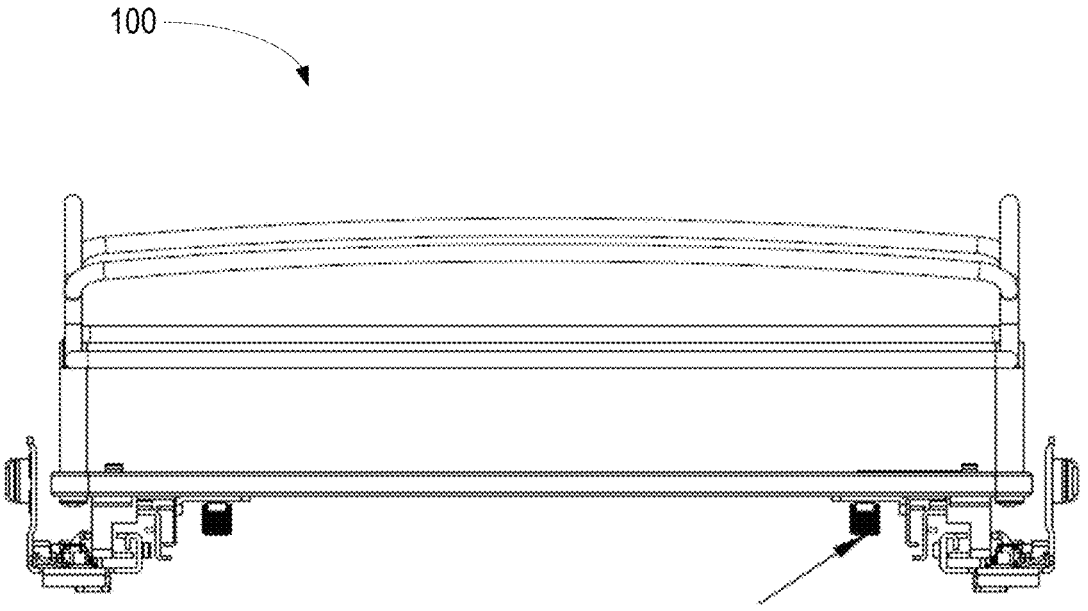
FIG. 7A is a front elevation view of the example cabinet storage system of FIG. 1.
Figure 7B:
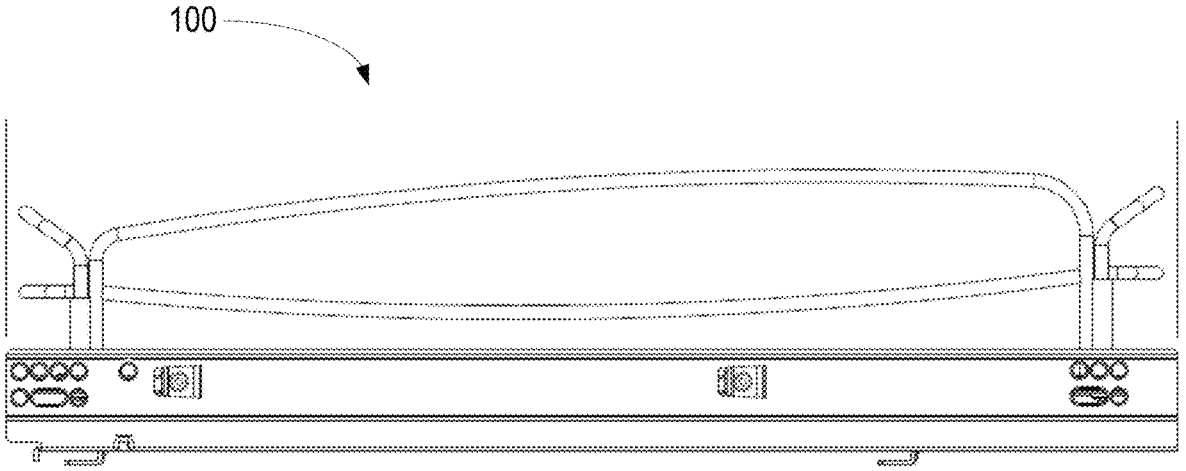
FIG. 7B is a side view of an example of the cabinet storage system of FIG. 1.

As illustrated in example of FIG. 2, the cabinet storage system 100 may also include a bracket 204 having an upper foot 206 that wraps the base 102 and is positioned contiguous with the planar surface of the base 102. As illustrated in the example of FIG. 5, the bracket 204 also includes a lower foot 502, which contiguously aligns with a lower planar surface of the base 102, such that the bracket 204 wraps around the base 102, which is fixedly held between the upper foot 206 and the lower foot 502. In this configuration, the bracket 204 provides horizontal, vertical and torsional support for the cabinet storage system 100. The bracket 204 also includes a vertical strut 504 and a face frame bracket 506. As illustrated in FIG. 5, the face frame bracket 506 is adjustable vertically one the vertical strut 504 by a finger slot 508 held against the face frame bracket by a releasable fastener, such as a threaded screw. The face frame bracket 506 includes a plurality of apertures 510, any one or more of which are available to couple a cabinet front, such as a drawer front or a door front to the cabinet storage system 100.

As illustrated in 4, the cabinet storage system 100 may be positioned in a cabinet such that a face frame 402 of the cabinet is aligned in the same plane with a front face of the face frame bracket 506. In this way, a front face, such as a drawer or door coupled with the face frame bracket 506 may also be in alignment with the face frame 402. Alignment of the cabinet storage system 100 such that a front planar surface of the face frame bracket 506 occupies the same plane with the face frame 402 of the cabinet may be accomplished using a face frame lip standoff 404 extending from a front edge of the slide 110 a predetermined distance. The face frame lip standoff 404 may butt up against a lip or rail 406 coupled with the bottom of the cabinet and abutting an inner surface of a lower face frame portion 408 of the face frame 402. When the face frame lip standoff 404 is butted against the rail 406, the planar surface of the face frame bracket 506 may extend a predetermined offset (O) distance beyond a contact surface 410 of the face frame lip standoff 404. The predetermined offset (O) is equal to the width of the rail 406 and the face frame bottom portion 408. Accordingly, a cabinet front, such as a drawer front or a door front, coupled with the face frame bracket 506 may be aligned with the face frame 402 of the cabinet. In cabinets without a face frame, the predetermined offset (O) may be the width of the rail 406 such that the cabinet front aligns with the front edges of the cabinet box. Accordingly, during installation of the cabinet storage system 100 in a cabinet, butting the face frame lip standoff 404 against the rail 406 automatically aligns a later installed front face, such as a drawer front or door front, with the face frame of the cabinet or the cabinet box itself where the face frame is omitted.

The fixed base portion 312 of the slides 110 of the cabinet storage system 100 may be coupled with the bottom of a cabinet. In order for the rail and face frame (if present) to not interfere with the slide action as the cabinet storage system 100 is slide between the inside and the outside of the cabinet, the slides 110 may include feet 316 as illustrated in FIGS. 3 and 8. The feet 316 may provide a vertical clearance of the slides 110 above the bottom of the cabinet.

Figure 9:
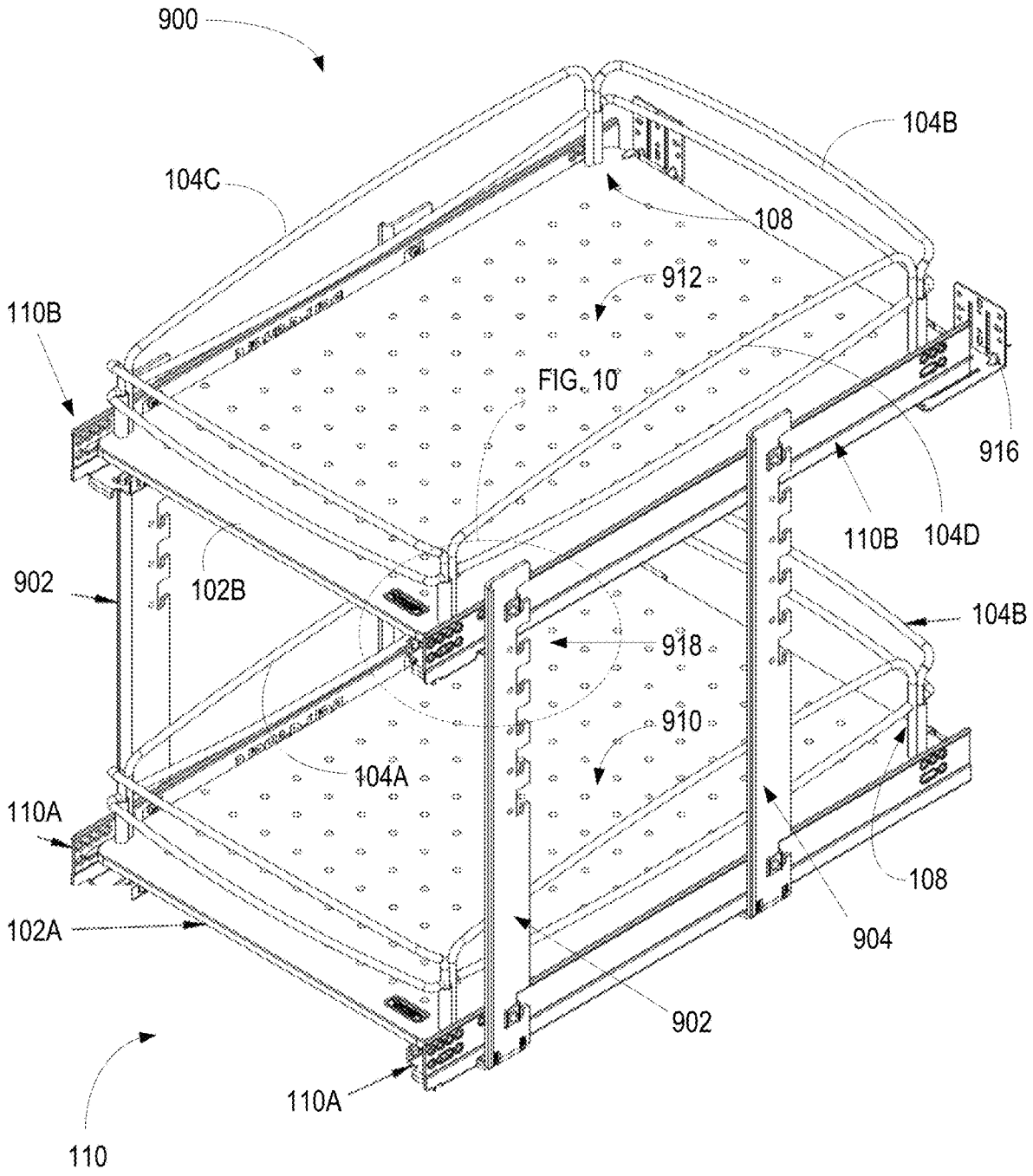
FIG. 9 is a perspective view of another example cabinet storage system.

FIG. 9 is a perspective view of another example cabinet storage system 900. The cabinet storage system 900 in FIG. 9 may be described as a multi-level cabinet storage system 900. The cabinet storage system 900 may include multiple bases 102A and 1028, fences 104, structural columns 108, and slides 110. Unless otherwise indicated, the features and functionality of the cabinet storage system 100 discussed with reference to FIGS. 1-8 are similar to the features and functionality of the cabinet storage system 900 discussed with reference to FIGS. 9-13. Accordingly, for purposes of brevity the details of these features and functionality will not be fully repeated, and it should be understood that features and functionality are fully interchangeable, combinable, and/or useable in the example systems described herein.

The bases 102A and 1028, or shelves, are fixedly coupled between the front and rear vertical opposing members 902 and 904 such that the planar surfaces of the bases 102 are transversely aligned with vertical planes defined by the front and rear vertical members 902 and 904. The bases 102 include a first drawer 910, or lower drawer, proximate a base of the multi-level storage container 900, and one or more upper drawers 912, or second drawer, vertically spaced above the first drawer 910. In the example of FIG. 9, two drawers are illustrated. In other examples, any number of one or more upper drawers may be vertically positioned above the bottom drawer 910.

The multi-level storage system 900 also includes a set of slide members 110A positioned on opposing sides of the lower drawer 910 and a set of slide members 1108 positioned on opposing sides of the upper drawer 912. The opposing sides are represented by the side edges of the multi-level storage system 900, which may include lateral opposing edges of the drawers 910 and 912. The each set of slide members 110 include a first slide member and a second slide member. The first set of slide members 110A are coupled with the base 102A of the lower drawer 910 and the second set of slide members 1108 is coupled with the base 102 of the upper drawer 912 of the multi-level cabinet storage container 900. The second set of slide members 912 are also coupled with brackets 916 for coupling the cabinet storage system 900 to a rear wall of a cabinet.

Figure 10:
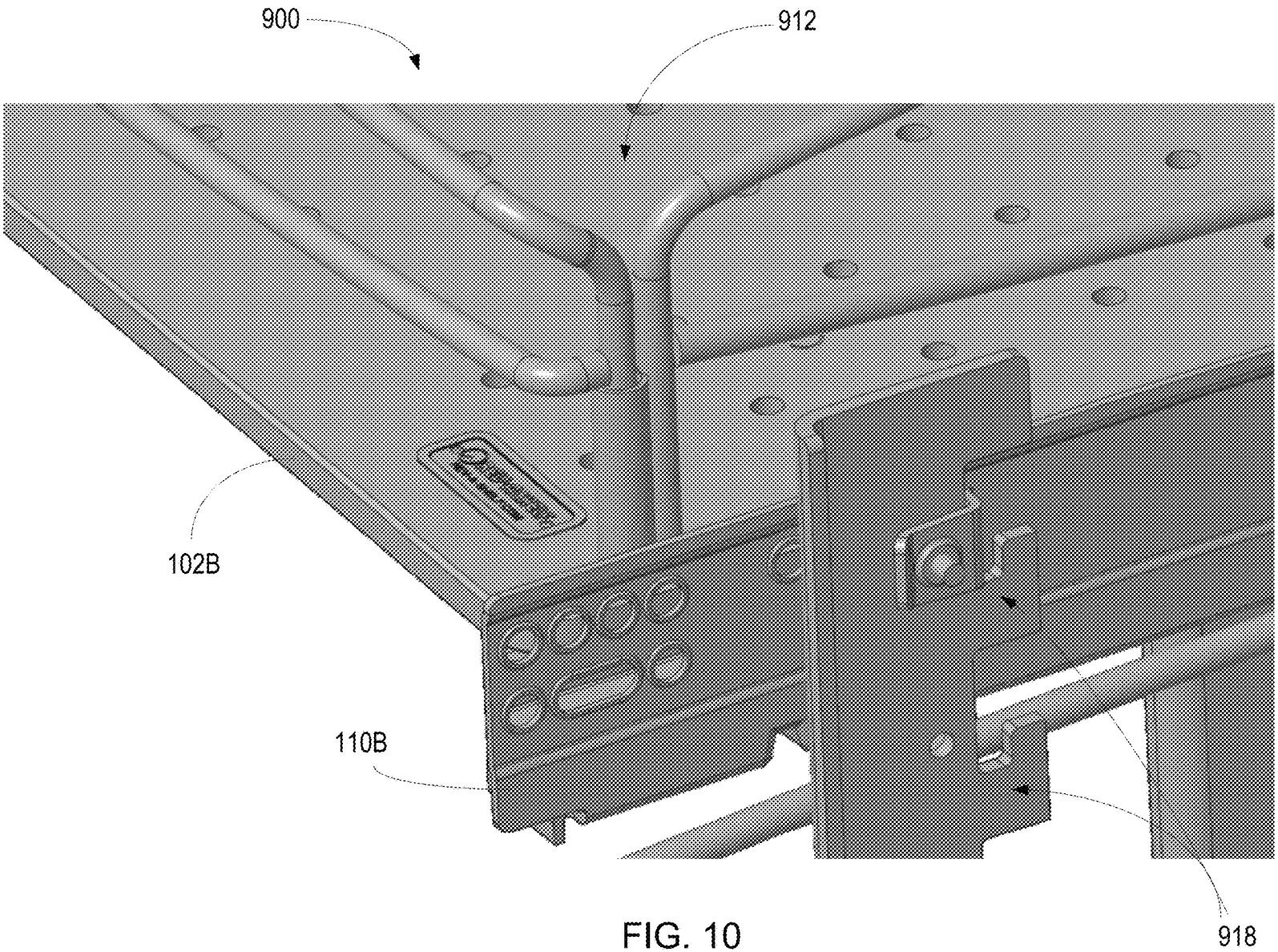
FIG. 10 is a perspective view of a top portion of another example cabinet storage system similar to the system of FIG. 9.
Figure 11:
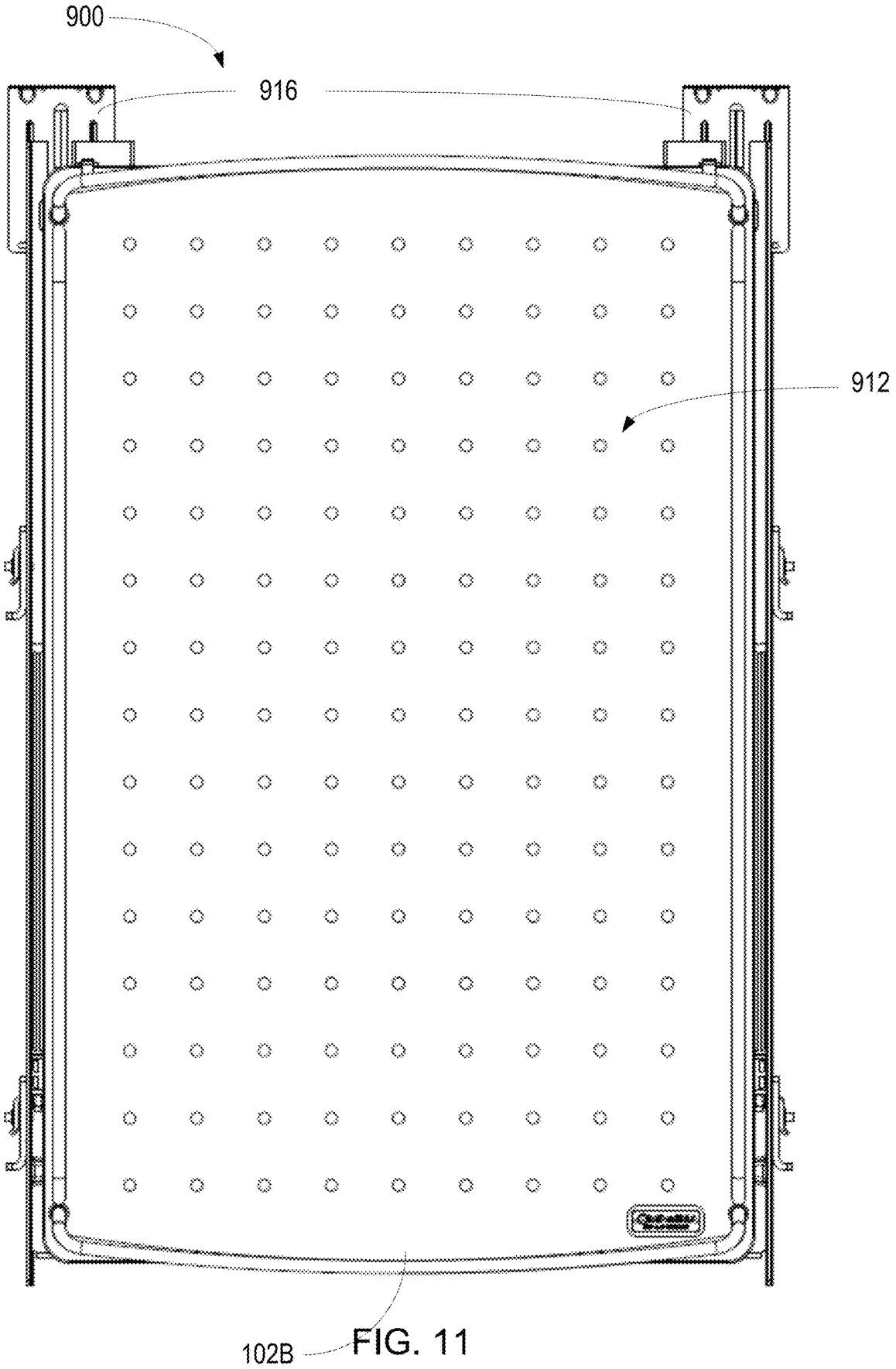
FIG. 11 is top view of the example cabinet storage system of FIG. 9.

The front and rear vertical opposing members 902 and 904 are coupled with the first set of slides 110A and the second set of slides 1108. The first set of slides 110A are fixedly coupled with the front and rear vertical opposing members 902 and 904. As illustrated in FIGS. 9 and 10, the second set of slides 912 are adjustably coupled with the front and rear vertical opposing members 902 and 904 by adjustable brackets 918 such that the upper drawer 912 is adjustable to a number of different heights above the lower drawer 910. In addition, or alternatively, additional upper drawers 912 may be separately coupled with the front and rear vertical opposing members 902 and 904 by the adjustable brackets 918.

Figure 12:
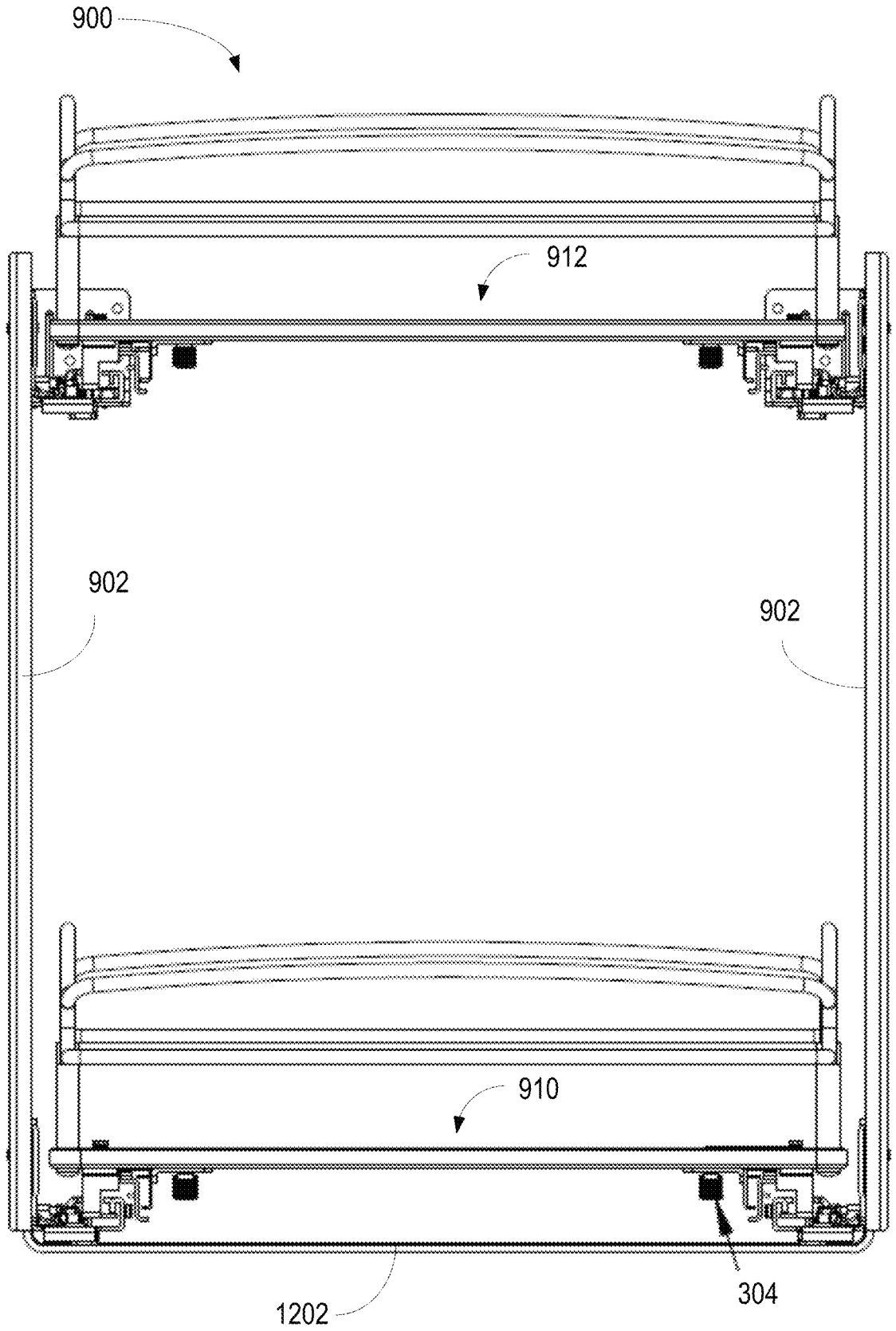
FIG. 12 is a front elevation view of the example cabinet storage system of FIG. 9.
Figure 13:
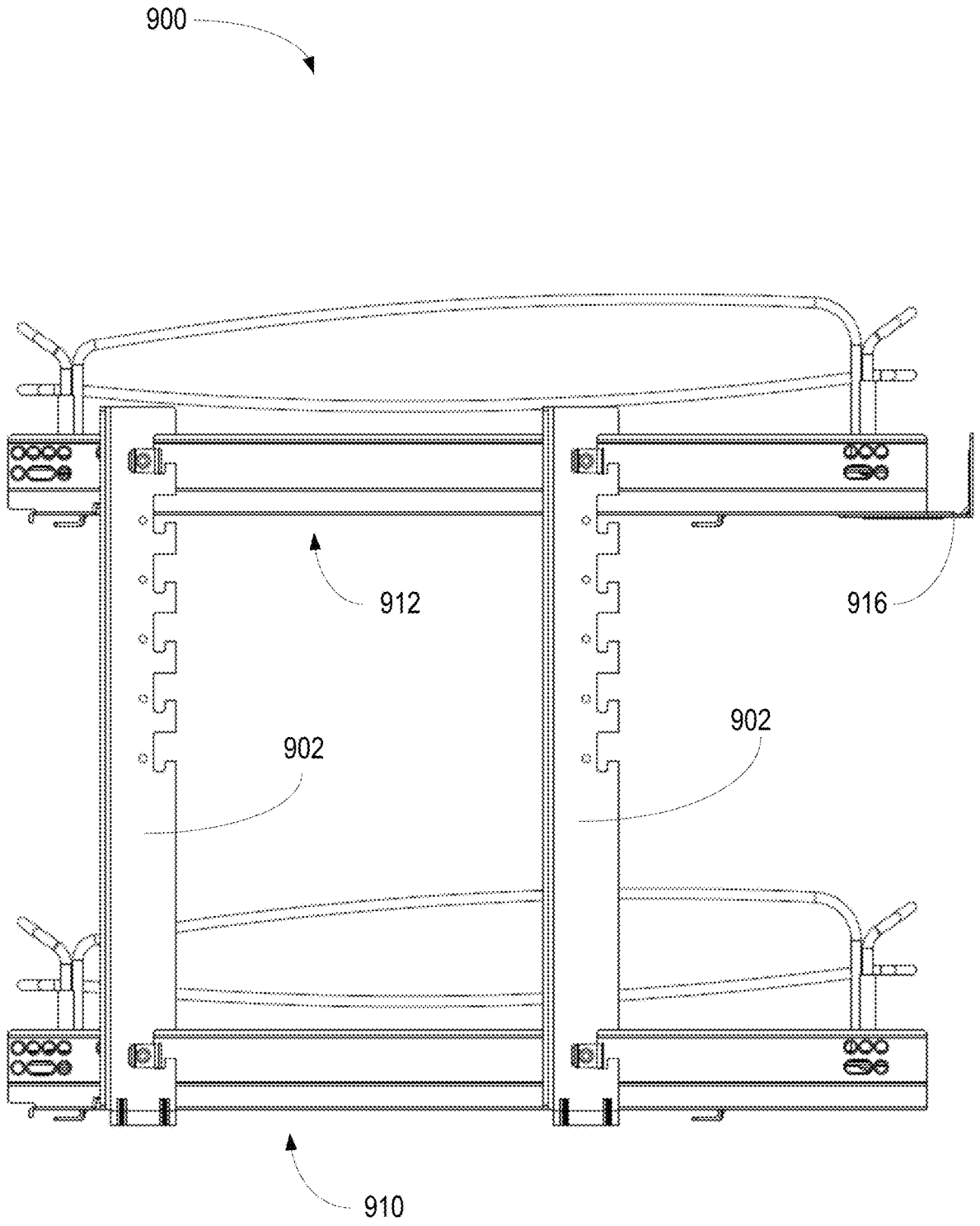
FIG. 13 is a side view of an example of the cabinet storage system of FIG. 9.

As illustrated in FIGS. 12 and 13, the front and rear vertical opposing members 902 and 904 may extend to the set of slide members 110A coupled with the lower shelf 910 and be coupled with a horizontal strut 1202. The strut 1202 may extend between the slides 110A and include apertures to allow coupling to the bottom of a cabinet in which the cabinet storage system 900. The strut 1202 may provide structural support for the first and second drawers 910 and 912, and may raise the first pair of slides 110A off the bottom of the cabinet. Accordingly, in the example of FIG. 12, the feet 316 may be omitted from the pair of slides 110A, or not used. In other examples first and second drawers 910 and 912 may have other forms of structural support, the strut 1202 may be omitted, and the feet 316 may be used to raise the height of cabinet storage system 900 to clear a face frame and/or rail included at the bottom of the cabinet.

Figure 14:
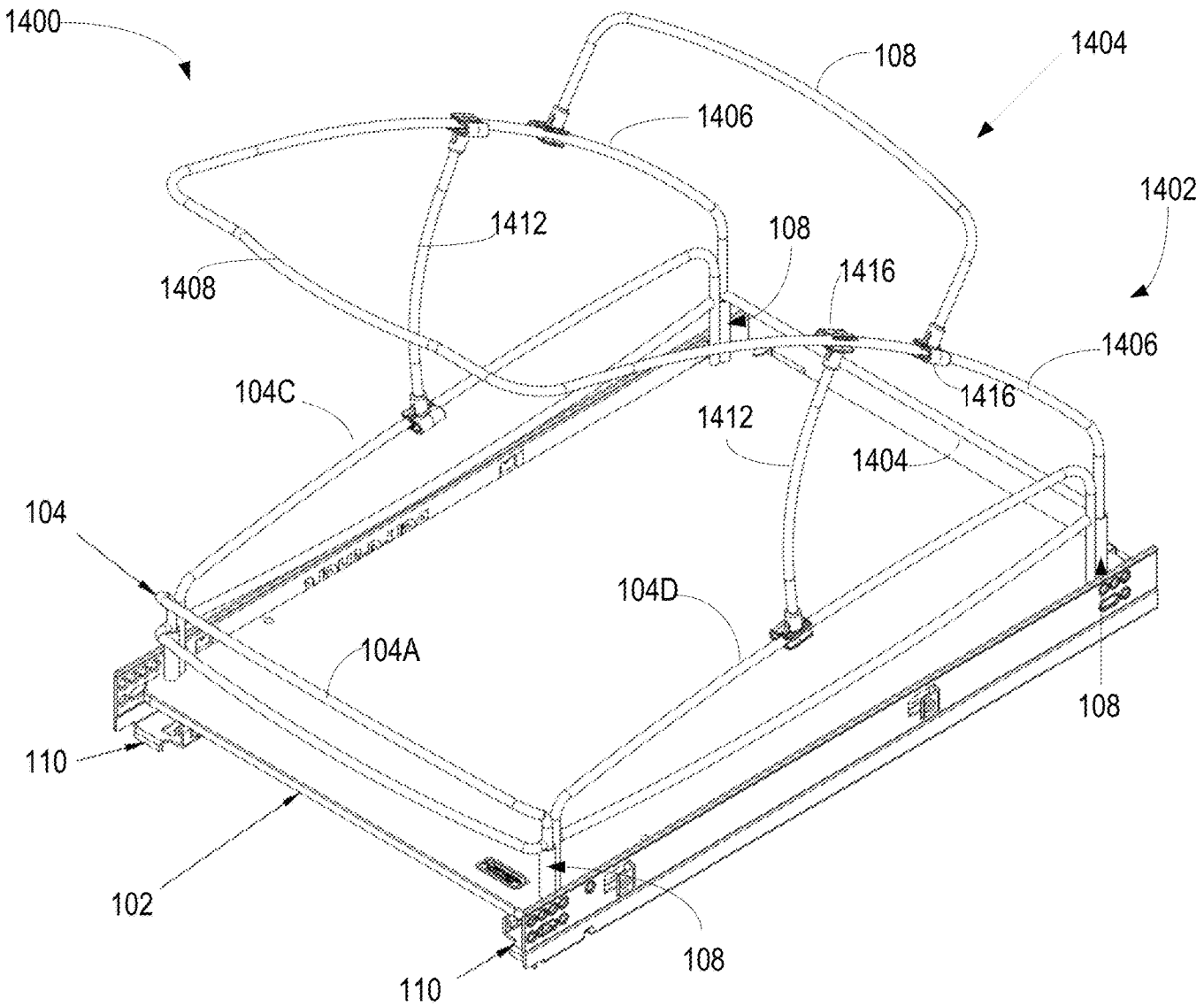
FIG. 14 is a perspective view of another example cabinet storage system.
Figure 15:
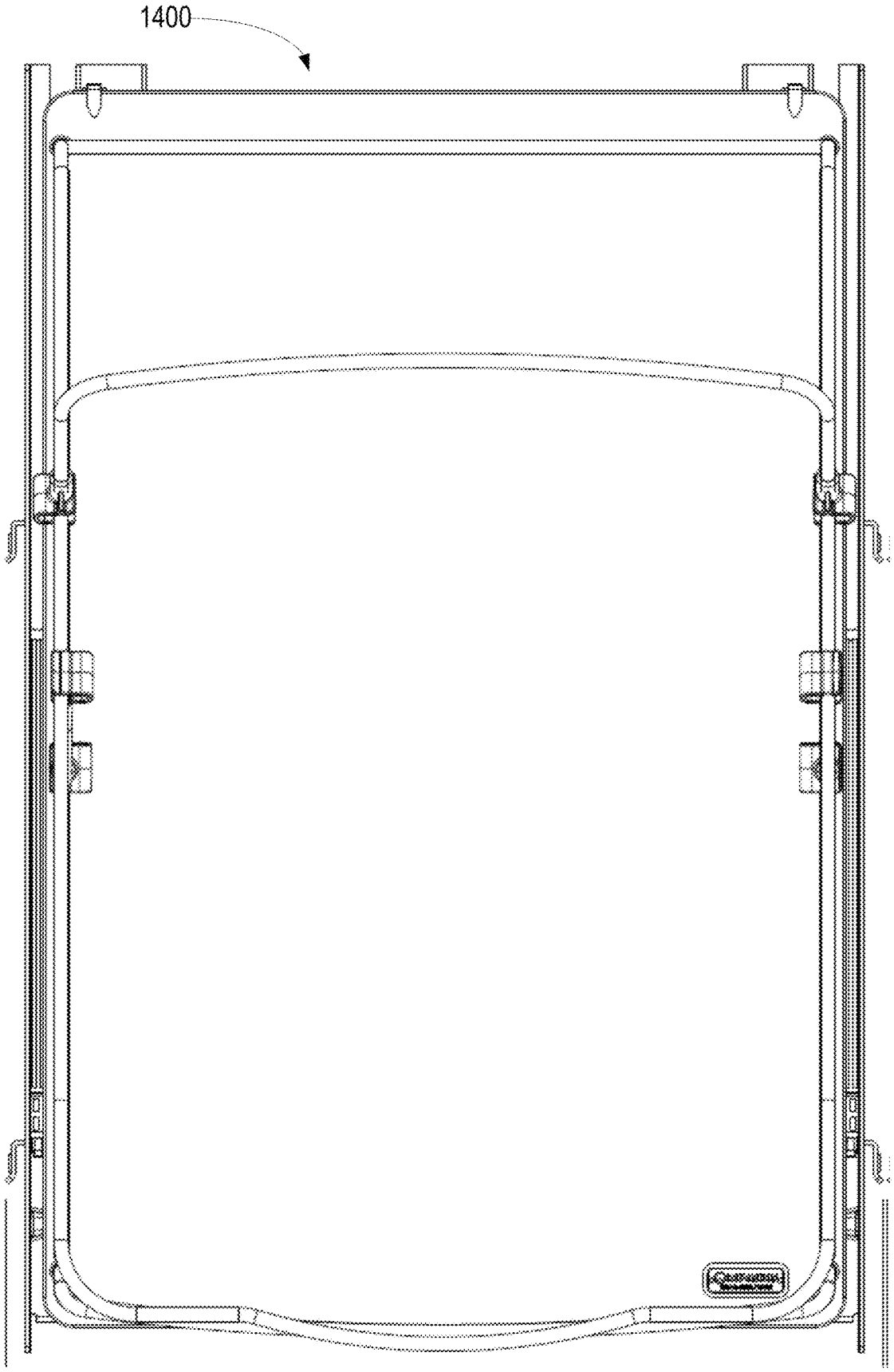
FIG. 15 is top perspective view of the example cabinet storage system of FIG. 14.
Figure 16:
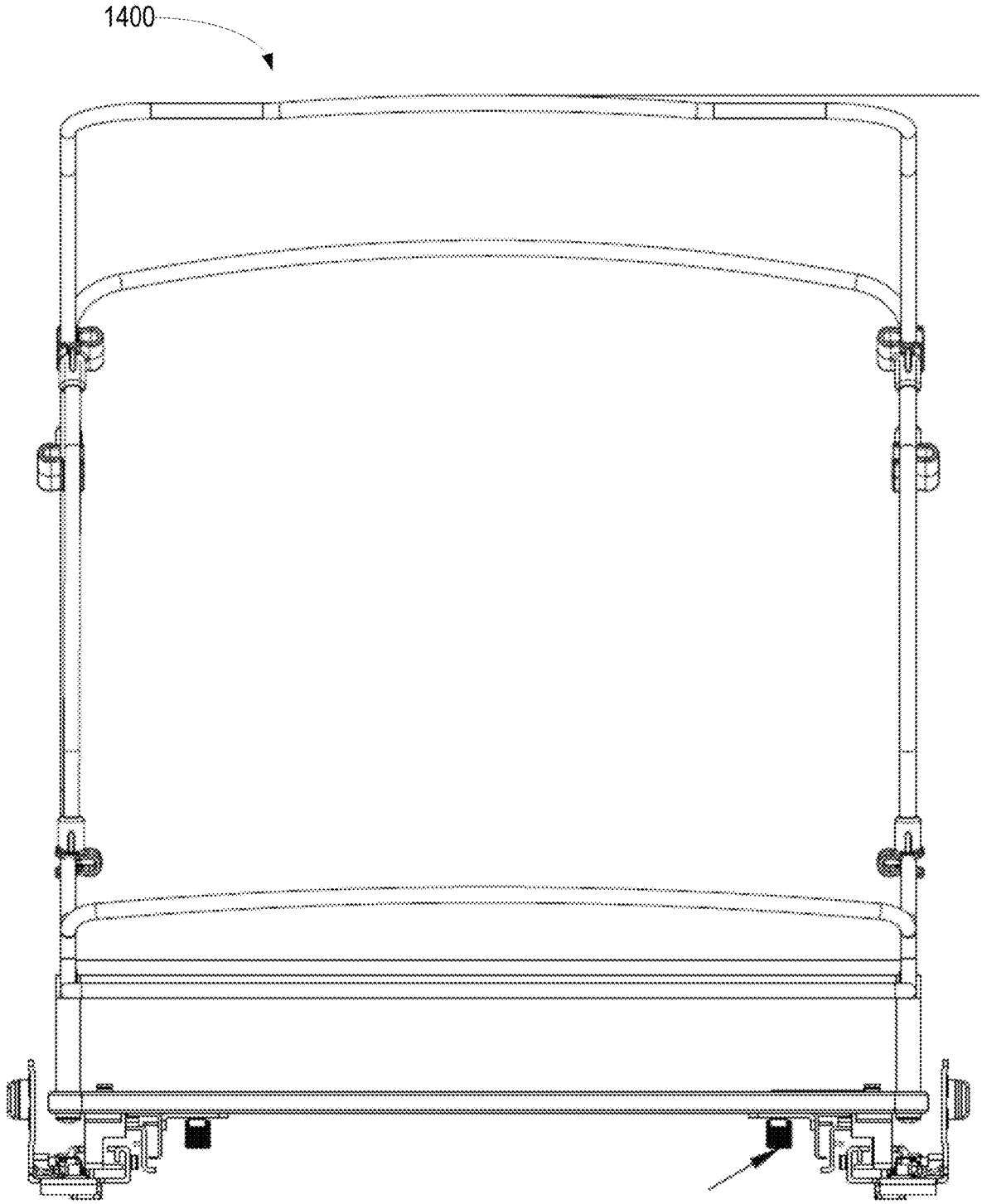
FIG. 16 is a front elevation view of the example cabinet storage system of FIG. 14.
Figure 17:
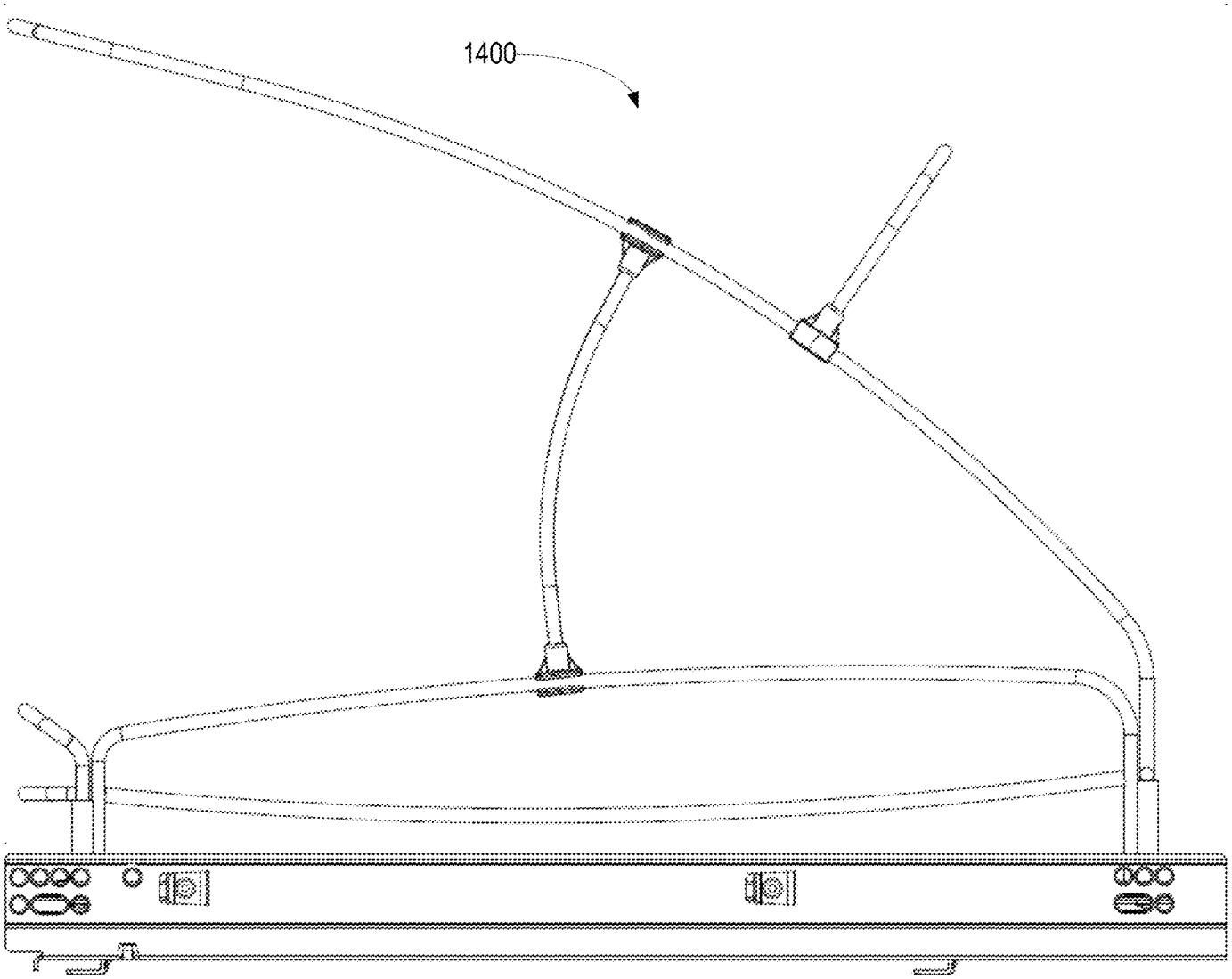
FIG. 17 is a side view of an example of the cabinet storage system of FIG. 14.

FIG. 14 is a perspective view of another example cabinet storage system 1400. The cabinet storage system 1400 may also be referred to as a slide-out cabinet storage system for a waste bin. Referring to FIGS. 14-18 and 20, the cabinet storage system 1400 may include the base 102, the fences 104 the structural columns 108 and the slides 110. Unless otherwise indicated, the features and functionality of the cabinet storage system 100 discussed with reference to FIGS. 1-8 and 19, and the cabinet storage system 900 discussed with reference to FIGS. 9-13 and 21 are similar to the features and functionality of the cabinet storage system 1400 discussed with reference to FIGS. 14-18 and 20. Accordingly, for purposes of brevity the details of these features and functionality will not be fully repeated, and it should be understood that features and functionality are fully interchangeable, combinable, and/or useable in the example systems described herein.

In the example of FIG. 14, the example cabinet storage system 1400 includes a front fence 104A, and opposing sides fences 104C and 104D each of which include horizontally extending top and bottom members that are generally parallel. In this example, the rear fence 1402 includes a single horizontal member 1404 extending between the structural columns 108 generally parallel with the base 102. In addition, the rear fence 1402 includes a cantilevered keeper 1404 as illustrated in FIGS. 14-17. The cantilevered keeper 1404 includes to side members 1406 and a handle member 1408. The side members 1406 extending from the structural columns 108 at the back of the cabinet storage system 1400 vertically and toward the front of the cabinet storage system 1400 above the respective side fences 104C and 104D. The handle member 1408 may be suspended vertically above the front fence 104A and generally parallel with the two members forming the front fence 104A. A pair of struts 1412 may be coupled between side fences 104C and 104D and the side members 1406 by fasteners 1416 to provide structural support to the cantilevered keeper 1404. A rear bracket 108 may also be coupled with side members 1406 by fasteners 1416.

Figure 18:
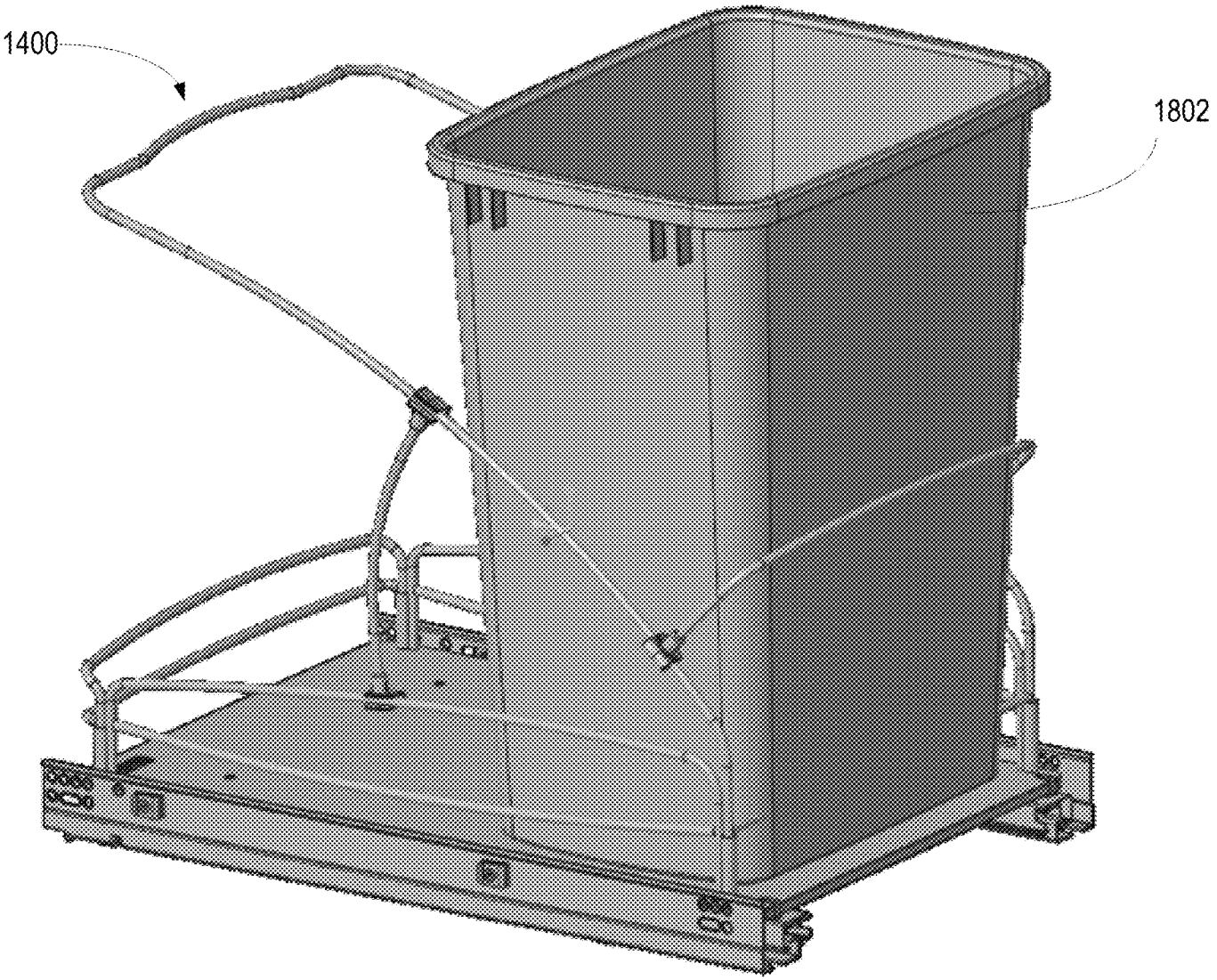
FIG. 18 is a perspective view of another example of a cabinet storage system.
Figure 19:
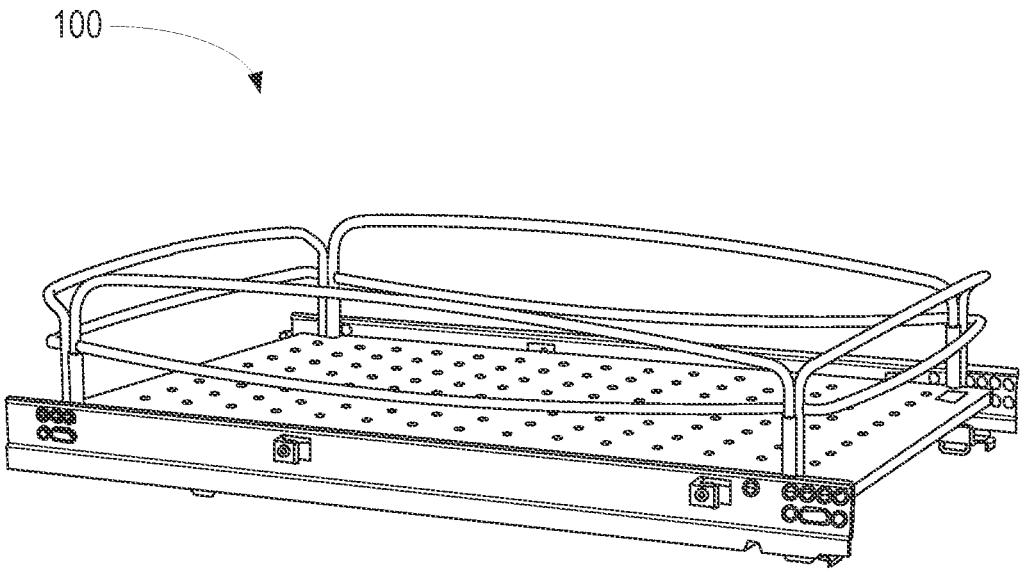
FIG. 19 is a perspective view of an example single drawer cabinet storage system.
Figure 20:
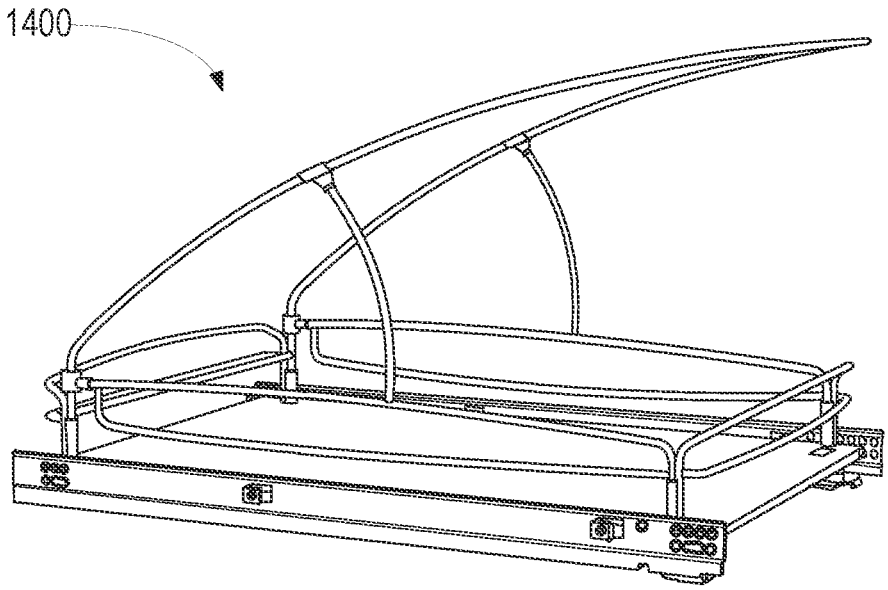
FIG. 20 is a perspective view of another example of a slide out cabinet storage system.

The cantilevered keeper 1404 may be sized and shaped to receive at least one container 1802 as illustrated in FIG. 18. The at least one container may be maintained in position on the base 102 as the base 102 is slid in and out of a cabinet by the cantilevered keeper 1404. In addition, the handle member 1404 may be used to actuate the slides 110 to move the base 102 by grabbing and pulling or pushing the cantilevered keeper 1404.

Figure 22:
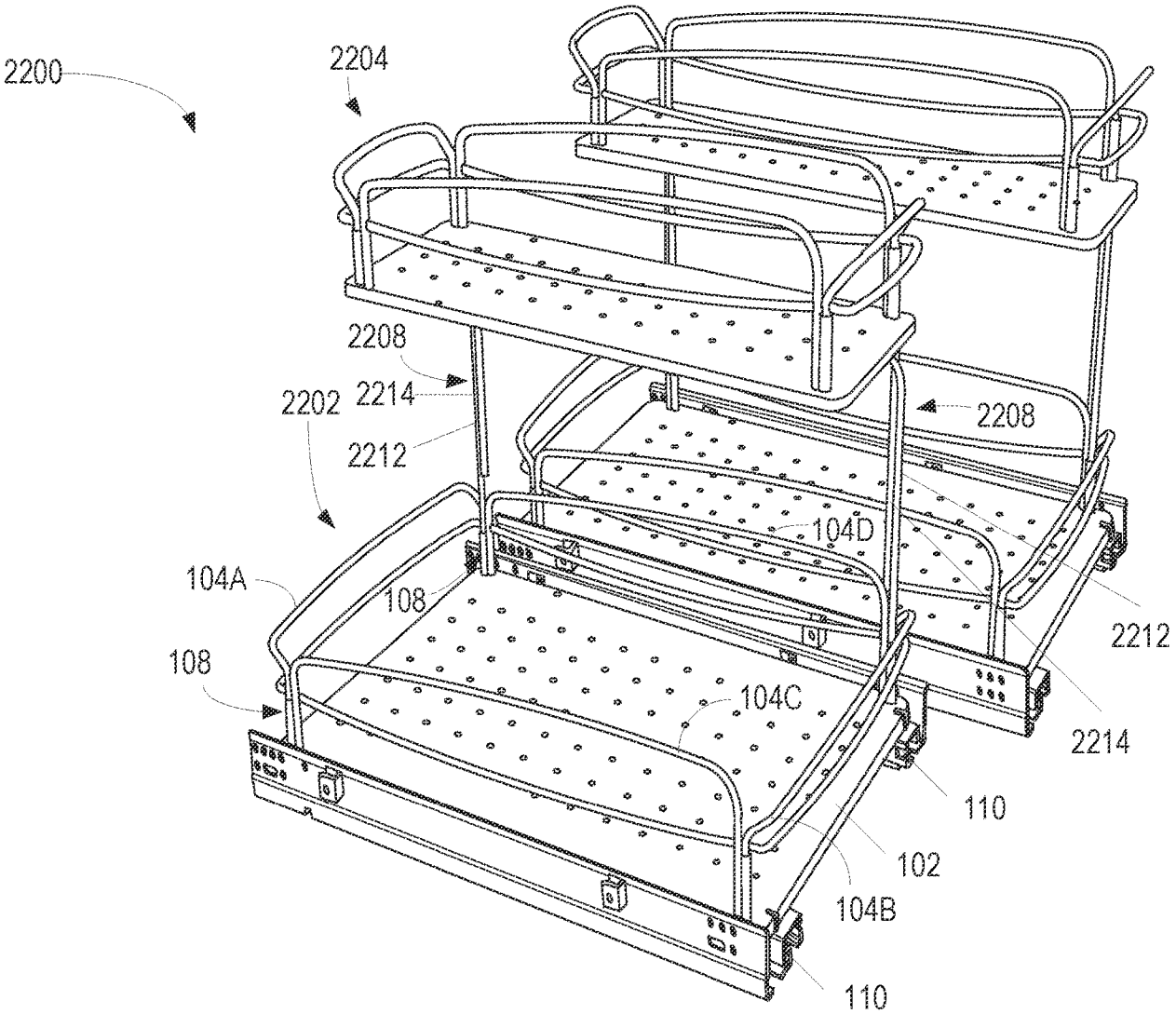
FIG. 22 is a perspective view of another example a single drawer upper shelf cabinet storage system.

FIG. 22 is another example cabinet storage system 2200 that includes a large shelf 2202 positioned as the lower drawer, and a smaller shelf 2204 positioned as an upper shelf. The cabinet storage system 2200 of FIG. 22 may also be described as a single drawer upper shelf cabinet storage system. In FIG. 22, two cabinet storage systems 2200 are illustrated providing examples of different sizes of the large shelf 2202 and the smaller upper shelf 2204. Unless otherwise indicated, the features and functionality of the cabinet storage system 100 discussed with reference to FIGS. 1-8 and 19, the cabinet storage system 900 discussed with reference to FIGS. 9-13 and 21, and the cabinet storage system 1400 discussed with reference to FIGS. 14-18 and 20 are similar to the features and functionality of the cabinet storage system 2200 discussed with reference to FIG. 22. Accordingly, for purposes of brevity the details of these features and functionality will not be fully repeated, and it should be understood that features and functionality are fully interchangeable, combinable, and/or useable in the example systems described herein.

The cabinet storage system 2200 includes a base 102, a pair of slides 110 a front fence 104A, a rear fence 1048 and side fences 104C and 104D coupled with the base 102 by structural columns 108. In this example, the front fence 104A and the rear fence 1048 each include a two horizontal substantially parallel members extending along a perimeter of the base 102 and held by friction fit in respective structural columns 108. In addition, side fences 104C and 104D each with two substantially parallel members fixedly coupled with the outer surface of the structural columns 108 and extending along a perimeter of the base 102.

Only one of the front fence 104A and the rear fence 1048 also include a upper shelf support member 2208. The upper shelf support member 2208 includes a first support member 2212 extending along the underside of the upper shelf 2204 parallel to the side fence 104D, and a second support member 2214 coupled with the structural column 108 of the upper shelf 2204.

It is now apparent that there are many advantages of the cabinet storage system provided herein. In addition to the advantages that have been described, it is also possible that there are still other advantages that are not currently recognized but which may become apparent at a later time.

While preferred embodiments of the cabinet storage system have been described, it should be understood that the disclosure is not limiting, and modifications may be made without departing from the features and functionality described. The scope of the disclosure is defined by the appended claims, and all devices that come within the meaning of the claims, either literally or by equivalence, are intended to embrace them.

What is claimed is:

1. A cabinet storage system for a cabinet comprising:

a base;

a pair of slides, each slide in the pair of slides comprising a slideable portion coupled with the base, and a fixed base portion for fixedly coupling with a cabinet, the pair of slides longitudinally extending in parallel on opposite sides of the base; and the fixed base portion comprising a face frame lip standoff extending from a front edge of each respective slide and extending away from the slideable portion, wherein the face frame lip standoff extends a predetermined distance from the front edge of each respective slide to butt against an inner surface of the cabinet and align the cabinet storage system in an opening in the cabinet, wherein the predetermined distance is a first predetermined distance and the cabinet storage system further comprises a bracket coupled with each respective slide, the bracket comprising a face frame bracket positioned to extend a second predetermined distance beyond the front edge of the respective slide, the face frame bracket adjustable and available to couple a cabinet front to the cabinet storage system, the first predetermined distance being less than the second predetermined distance, the bracket comprises an upper foot and a lower foot, the upper foot contiguously aligned with a first planar surface of the base, and the lower foot contiguously aligned with a second planar surface of the base, the first planar surface and the second planar surface being opposing planar surfaces of the base.

2. The cabinet storage system of claim 1, wherein a difference between the first predetermined distance and the second predetermined distance is a predetermined offset.

3. The cabinet storage system of claim 2, wherein the predetermined offset is greater than or equal to a width of a rail included in the cabinet as the inner surface of the cabinet.

4. The cabinet storage system of claim 3, wherein the predetermined offset is greater than or equal to the width of the rail included in the cabinet and a width of a face frame included in the cabinet.

5. The cabinet storage system of claim 1, wherein the bracket wraps around a peripheral edge of the base such that the base is fixedly held between the upper foot and the lower foot.

6. A cabinet storage system for a cabinet comprising:

a base;

a pair of slides, each slide in the pair of slides comprising a slideable portion coupled with the base, and a fixed base portion for fixedly coupling with a cabinet, the pair of slides longitudinally extending in parallel on opposite sides of the base;

the fixed base portion comprising a face frame lip standoff extending from a front edge of each respective slide and extending away from the slideable portion, wherein the face frame lip standoff extends a predetermined distance from the front edge of each respective slide to butt against an inner surface of the cabinet and align the cabinet storage system in an opening in the cabinet; and fasteners threadedly connected with the base, and ears fixedly coupled with slideable portion, the ears formed as planar members extending away from the slideable portion in parallel with the slideable member and the base such that the ears are respectively aligned with the base, and the base is coupled with the slideable portion by the fasteners being engaged with the ears.

7. The cabinet storage system of claim 6, wherein the ears include front ears and rear ears, the rear ears including an alignment notch having a tapered slot to align the pair of slides with the base, and the front ears including an aperture to receive respective fasteners to complete alignment of the pair of slides and the base.

8. A cabinet storage system comprising:

a pair of slides, each respective slide included in the pair of slides having a fixed portion and a slideable portion, the fixed portion fixedly mounting the cabinet storage system in a bottom of a cabinet;

a base having opposing planar surfaces and being coupled with the slideable portion of each respective slide on one of the opposing planar surfaces so as to extend slideably outside an opening in the cabinet with the slideable portion of each respective slide; and the fixed portion of each respective slide comprising a face frame lip standoff, extending away from the fixed portion in a same direction as the base slideably extends outside the opening in the cabinet, and the cabinet storage system being fixedly mountable in the cabinet such that the face frame lip standoff is contiguously aligned with an inner surface of a rail included at the bottom of the cabinet at the opening in the cabinet such that the base slideably extends past the inner surface of the rail before extending past an outer surface of the rail, through the opening, and outside the cabinet, wherein the base includes threaded apertures in one of the opposed planar surfaces, and the slideable portion includes a plurality of ears formed as planar members extending away from the slideable portion in parallel with the slideable member and the one of the opposed planar surfaces such that the ears are respectively aligned with fasteners threadedly engaged with the threaded apertures to fixedly couple the base to the slideable portion of each respective slide.

9. The cabinet storage system of claim 8, wherein the fixed portion of each respective slide includes a body, the face frame lip standoff being a portion of the body of the fixed portion of each respective slide.

10. The cabinet storage system of claim 9, wherein the fixed portion of each respective slide includes a plurality of feet extending away from the body of the fixed portion to contact the bottom of the cabinet and fixedly position the body away from the bottom of the cabinet such that the base and the slideable portion are slideable together outside the opening in the cabinet without contacting the rail.

11. The cabinet storage system of claim 10, wherein the body of the fixed portion of each respective slide is a monolithic one-piece structure formed to include the face frame lip standoff and the feet as part of the monolithic one-piece structure.

12. The cabinet storage system of claim 8, wherein the ears include front ears and guide ears, the guide ears including an alignment notch having a tapered slot configured to receive one of the fasteners threadedly engaged with the base such that the pair of slides are guided into alignment with the base via the slot, and a through-hole aperture in each of the front ears is aligned with a respective one of the threaded apertures included in the base.

13. A cabinet storage system comprising:

a pair of slides, each respective slide included in the pair of slides having a fixed portion and a slideable portion, the fixed portion fixedly mounting the cabinet storage system in a bottom of a cabinet;

a base having opposing planar surfaces and being coupled with the slideable portion of each respective slide on one of the opposing planar surfaces so as to extend slideably outside an opening in the cabinet with the slideable portion of each respective slide;

the fixed portion of each respective slide comprising a face frame lip standoff, extending away from the fixed portion in a same direction as the base slideably extends outside the opening in the cabinet, and the cabinet storage system being fixedly mountable in the cabinet such that the face frame lip standoff is contiguously aligned with a rail included at the bottom of the cabinet at the opening in the cabinet; and a respective bracket coupled with the slideable portion of each respective slide, the respective bracket wrapped around a peripheral edge of the base to provide horizontal, vertical and torsional support for the cabinet storage system.

14. The cabinet storage system of claim 13, wherein the respective bracket comprises an upper foot contiguously contacting a first planar surface of the opposing planar surfaces of the base, and a lower foot contiguously contacting a second planar surface of the opposing planar surfaces of the base.

15. The cabinet storage system of claim 13, wherein the respective bracket further comprises an adjustable face frame bracket for coupling with a drawer or door of the cabinet, the adjustable face frame bracket adjustable to align the drawer or door by a predetermined offset with respect to the face frame lip standoff such that the drawer or door aligns with a face frame of the cabinet.

16. A cabinet storage system comprising:

a base having a planar top surface and a planar bottom surface, the planar top surface and the planar bottom surface being opposing planar surfaces;

a first slide and a second slide, each of the first slide and the second slide including a base portion and a slideable portion;

wherein the slideable portion is fixedly coupled with the base, and the base portion is fixedly coupled with an interior bottom floor of a cabinet enclosure;

wherein the slideable portion of the first slide and the second slide and the base are slideable via an opening in the cabinet enclosure between inside the cabinet enclosure and outside the cabinet enclosure; and wherein the base portion of each of the first slide and the second slide includes a face frame lip standoff to butt against an interior surface of a rail facing the first slide and the second slide, the rail included at the interior bottom floor of the cabinet enclosure to align the base with the opening in the cabinet enclosure, and wherein the base portion comprises a body formed to include a plurality of mounting feet as part of the body, the mounting feet to fixedly couple the base portion with the interior bottom floor of the cabinet enclosure, the mounting feet punched out of the body to extend away from the body of the base portion a predetermined distance such that the body of the base portion is aligned in the cabinet enclosure spaced away from the interior bottom floor and the slideable portion protrudes out of the opening without contacting the rail.

* * * * *